US005858596A

United States Patent [19]

Tajima et al.

[11] Patent Number: 5,858,596

[45] Date of Patent: Jan. 12, 1999

[54] DEVELOPER COMPOSITION FOR ELECTROSTATIC LATENT IMAGES

[75] Inventors: Hisakazu Tajima; Yukiya Sato; Masayuki Maruta; Atsushi Sonobe, all of Wakayama, Japan

[73] Assignee: Kao Corporation, Tokyo, Japan

[21] Appl. No.: 672,479

[22] Filed: Jun. 26, 1996

[30] Foreign Application Priority Data

Jun. 26, 1995 [JP] Japan ..... 7-183565

[51] Int. Cl.[6] ..... G03G 9/097

[52] U.S. Cl. ..... 430/110; 430/111; 430/137

[58] Field of Search ..... 430/110, 111, 430/137

[56] References Cited

U.S. PATENT DOCUMENTS

| | | | |
|---|---|---|---|
| 4,933,252 | 6/1990 | Nishikawa et al. | 430/109 |
| 4,960,665 | 10/1990 | Elder et al. | 430/111 |
| 4,981,923 | 1/1991 | Hagiwara et al. | 430/109 |
| 5,047,305 | 9/1991 | Uchida et al. | 430/110 |
| 5,424,162 | 6/1995 | Kohri et al. | 430/111 |

FOREIGN PATENT DOCUMENTS

| | | |
|---|---|---|
| 55-40407 | 8/1980 | Japan . |
| 56-065147 | 6/1981 | Japan . |
| 3-163564 | 7/1991 | Japan . |

*Primary Examiner*—Roland Martin

*Attorney, Agent, or Firm*—Birch, Stewart, Kolasch & Birch, LLP

[57] ABSTRACT

The developer composition for electrostatic latent images includes a toner and a carrier, the toner including (a) a binder resin comprising a polyester resin having an acid value of from 0 to 10 KOH mg/g; (b) a wax; and (c) a colorant. In the developer composition, the wax is dispersed in the toner with a length to diameter ratio of from 2 to 15.

15 Claims, 2 Drawing Sheets

DEVELOPER COMPOSITION FOR ELECTROSTATIC LATENT IMAGES

BACKGROUND OF THE INVENTION

1. Field of the Invention

The present invention relates to a developer composition for electrostatic latent images employed in electrophotography, electrostatic recording, electrostatic printing, etc. More specifically, the present invention relates to a two-component developer composition utilized in magnetic brush development showing high performance even under low-temperature, low-humidity conditions and high-temperature, high-humidity conditions.

2. Discussion of the Related Art

The chargeability of the toners usable in development of electrostatic latent images in electrophotography, etc. is an important factor for giving good image quality. This chargeability is variable by temperature and humidity conditions, and hence is susceptible to undergo environmental changes, the chargeability of the toners being increased under low-temperature, low-humidity conditions, and decreased under high-temperature, high-humidity conditions, thereby resulting in the deterioration of the image quality.

The binder resins usable in the toners for development of electrostatic latent images generally include various resins, such as homopolymers or copolymers of styrenic monomers, such as polystyrene, styrene-butadiene copolymers, and styrene-(meth)acrylic acid ester copolymers; homopolymers or copolymers of ethylenic monomers, such as polyethylenes and ethylene-vinyl acetate copolymers; polyester resins; epoxy resins; and polyamide resins. However, the chargeability of the toners is liable to undergo substantial changes by the environmental conditions, though they may have some differences depending on the kinds of the binder resins used. Particularly, when the resulting toners are used under high-temperature, high-humidity conditions, the deterioration of the formed images is liable to take place. Particularly in a case where a polyester resin is used as a binder resin, it has been pointed out that since the polyester resin is obtainable by condensation polymerization of an alcohol and a carboxylic acid, a large number of carboxyl groups, which are hydrophilic groups, are present in the resin. Therefore, hydrogen bonds are formed between the carboxyl groups and water molecules, which result in the lowering of the chargeability of the toners, and thereby the deterioration of the formed images under high-temperature, high-humidity conditions is liable to take place.

However, in the field of electrophotography, the polyesters resins are widely used as binder resins for toners owing to their excellent fixing ability and high negative chargeability. Particularly in cases for producing color toners, the superiority of the polyester resins is well supported when compared with other resins in transparency as well as in the fixing ability and the negative chargeability. From the above facts, the development of a developer having little influence to environmental changes, while sufficiently utilizing the properties inherently owned by the polyester resins, is in demand.

Recently, in view of the above, various proposals have been made in the preparation of polyester resin-based toners, including methods for adjusting acid values of polyester resins (Japanese Patent Laid-Open Nos. 55-40407 and 56-65147); methods for adjusting a total amount of acid values and hydroxyl values of polyester resins (Japanese Patent Laid-Open No. 3-163564); methods for substituting a nitrogen-containing functional group for a carboxyl group of polyester resins; methods for increasing hydrophobicity of polyester resin-based toners by subjecting the toners with low acid values and low hydroxyl values to a surface treatment.

Among the methods mentioned above, the methods for controlling the acid values of the polyester resins to a range lower than those of conventional polyester resins, for instance from 0 to 10 KOH mg/g, are known to sufficiently prevent the lowering of the chargeability particularly under high-temperature, high-humidity conditions, so that the deterioration of the formed images can be prevented.

On the other hand, the electrophotograhic techniques recently have a tendency of digitization. For instance, by employing image-treatment techniques or A.I. techniques, digitized copy machines and color digitized copy machines having high reliability document-producing or image-producing functions have been appeared. In these digitized methods, since the toning of the formed images is controlled by dotted areal toning utilizing dotted images, the image densities of the dotted images have to be maintained at high levels even when developed at a low development voltage region. Therefore, the toners usable for digitized methods are required to have distinctive properties, i.e. the properties of providing high image densities even at a low development voltage, which are different from those usable for image-forming processes utilizing analog optical methods whose image toning changes depending upon the levels of the development voltage.

However, in the toners comprising polyester resins having low acid values mentioned above, the resulting formed images normally can have only low image densities at a low development voltage, and hence their image densities at low development voltages must be further increased in order to use these toners with such excellent environmental properties for digitized methods.

SUMMARY OF THE INVENTION

In view of the above problems, an object of the present invention is to provide a developer composition which is suitably usable for image-forming processes employing optical, digitized system owing to the fact that it can provide images with high concentration at a low development voltage, the developer composition having excellent environmental properties and showing high performance. In other words, the object is to provide a developer composition suitable for the modern digitization while sufficiently utilizing the properties inherently owned by the polyester resins, which have excellent environmental stability, fixing ability, and transparency.

As a result of intense research in view of the above problems, the present inventors have found that the resulting formed images with high image densities even at a low development voltage can be obtained by improving the dispersibility of the wax, though the dispersibility of the wax is poorer than that of a usual polyester in a toner composition containing a polyester resin having a low acid value and a wax. The present invention has been completed based upon this finding.

In one aspect, the present invention is concerned with a developer composition for electrostatic latent images comprising a toner and a carrier, the toner comprising:

(a) a binder resin comprising a polyester resin having an acid value of from 0 to 10 KOH mg/g;

(b) a wax; and (c) a colorant, wherein the wax is dispersed in the toner with a length to diameter ratio of from 2 to 15.

DETAILED DESCRIPTION OF THE INVENTION

Figure 1:
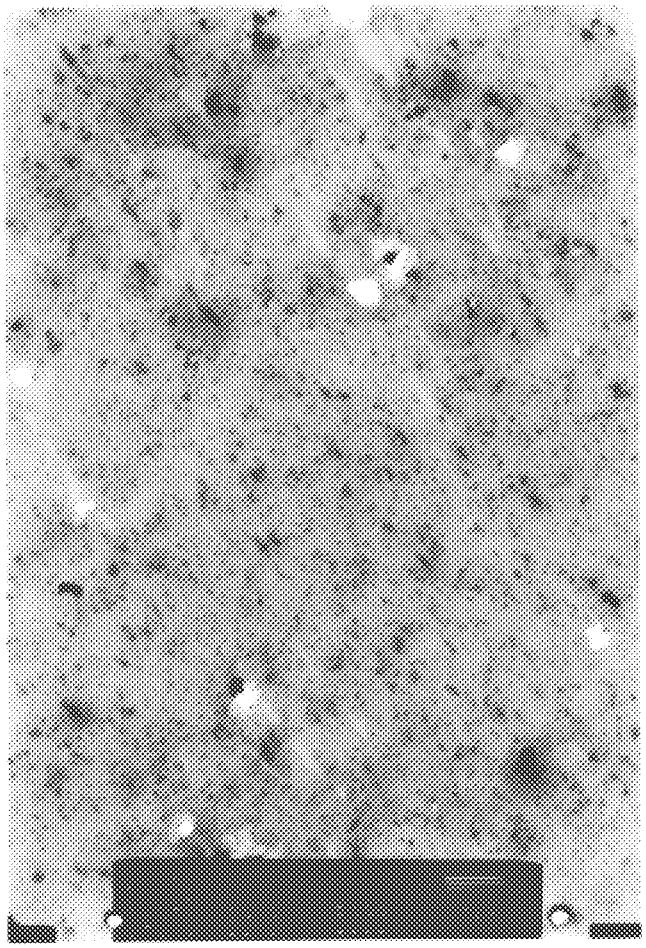
FIG. 1 is a microphotograph showing a particle structure of a toner obtained in Production Example of Toner 1 whose cross section is observed by a transmission electron microscope.
Figure 2:
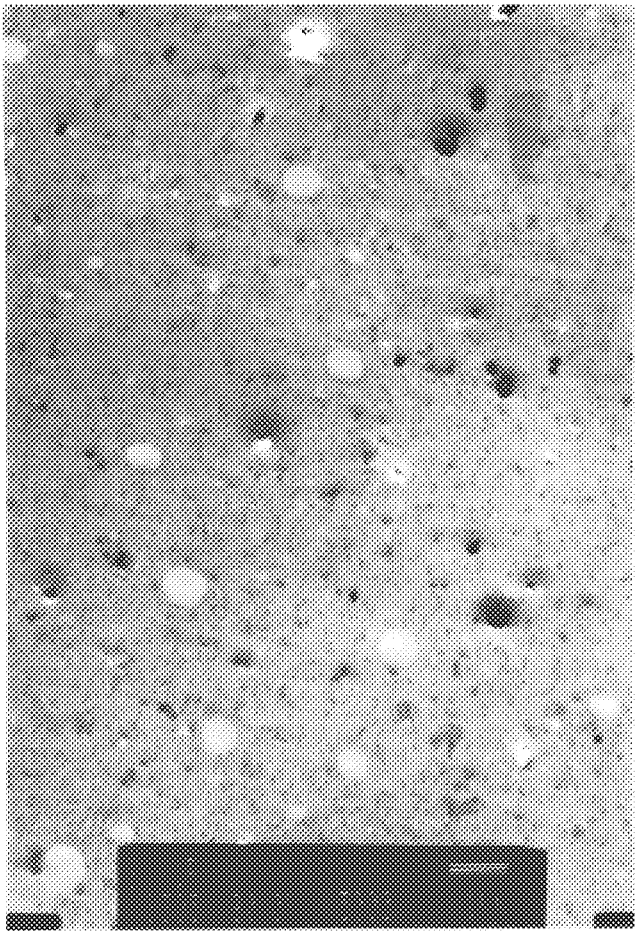
FIG. 2 is a microphotograph showing a particle structure of a toner obtained in Production Example of Toner 4 whose cross section is observed by a transmission electron microscope.

The present invention will be explained in detail hereinbelow.

The toner usable in the present invention comprises:

(a) a binder resin comprising a polyester resin having an acid value of from 0 to 10 KOH mg/g;

(b) a wax; and (c) a colorant, wherein the wax is dispersed in the toner with a length to diameter ratio of from 2 to 15.

The polyester resin usable for a binder resin in the present invention is preferably used because of its excellent fixing ability owing to the fact that its ester moiety has a large cohesive energy and has a terminus carboxylic acid group. From the aspect of giving triboelectric stability under high-temperature, high-humidity conditions or low-temperature, low-humidity conditions, a preference is given to the polyester resins having acid values of from 0 to 10 KOH mg/g, particularly 1 to 5 KOH mg/g. Here, the acid value is measured by the method according to JIS K 0070. In order to adjust the acid value low within the above-given range, the polymerization reactions, mainly transesterification reaction, are carried out by making the amount of the alcohol monomer components comparatively large among the acid monomer components and the alcohol monomer components, or making the amount of carboxylic acid esters comparatively large in the acid component monomers.

In addition, in order to securely have good storage stability of the resulting toner, a preference is given to polyester resins obtainable by condensation polymerization between a polycarboxylic acid moiety and a diol moiety, wherein the polycarboxylic acid moiety has the following general formula (I) and the diol moiety has the following general formula (II) as main components thereof:

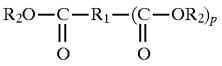

$$R_2O-\underset{\underset{O}{\|}}{C}-R_1-(\underset{\underset{O}{\|}}{C}-OR_2)_p \quad \text{(I)}$$

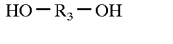

$$HO-R_3-OH \quad \text{(II)}$$

wherein "p" is a number equal to or greater than 1; $R_1$ stands for a benzene ring; $R_2$ stands for a hydrogen atom or a lower alkyl group; $R_3$ stands for a divalent group containing a bisphenol group or an alkylene group having 2 to 6 carbon atoms, wherein the amount of polycarboxylic acid components having "p" of equal to or greater than 2 is from 0.06 to 0.60 mol % in the entire acid components.

In particular, a preference is given to a dicarboxylic or higher polycarboxylic acid comprising terephthalic acid or a lower alkyl ester thereof as a main component thereof. By containing suitable amounts of tricarboxylic or higher polycarboxylic acid components, such as trimellitic acid, an acid anhydride thereof, and a lower alkyl ester thereof, good fixing ability and hot offset resistance can be achieved in the resulting polyester resin. However, when the amount of the tricarboxylic or higher polycarboxylic acid components is too small, sufficient effects cannot be obtained, and when the amount is too large, the acid value becomes large, thereby making it liable to decrease the triboelectric chargeability or liable to increase the crosslinking density of the polyester resin. Therefore, the amount of the tricarboxylic or higher polycarboxylic acid components is preferably from 0.06 to 0.60 mol % in the entire acid components.

Examples of the diols having the general formula (II) given above include polyoxypropylene bisphenol A, polyoxyethylene bisphenol A, ethylene glycol, propylene glycol, 1,6-hexanediol, and 1,4-butanediol.

Also, the polyester resin usable in the present invention preferably has a softening point determined by koka-type flow tester of from 120° to 180° C. When the polyester resin has a softening point of less than 120° C., although good fixing ability may be achieved, hot offset is liable to be generated by a heat roller, thereby necessitating to apply silicone oil onto the heat roller. Also, the durability of the developer is liable to be shortened. When the softening point of the polyester resin exceeds 180° C., the fixing ability is liable to be drastically poor. When the one or more monomers having flexibility listed below are contained, the fixing ability can be notably improved. These monomers are also applicable to polyester resins having softening points of less than 180° C., and the fixing ability can be improved.

The monomers having flexibility include the following diols and dicarboxylic acid components.

Examples of diols include ethylene glycol, diethylene glycol, propylene glycol, dipropylene glycol, 1,6-hexanediol, and 1,4-butanediol.

Examples of dicarboxylic acid components include fumaric acid, an alkylsuccinic acid or alkenylsuccinic acid whose alkyl or alkylene moiety has 4 to 12 carbon atoms, succinic acid, and adipic acid, acid anhydrides thereof, and lower alkyl esters thereof.

The polyester resin usable in the present invention can be produced by carrying out condensation polymerization reaction between a polycarboxylic acid component and a polyol component at a temperature of from 180° to 250° C. in an inert gas atmosphere. In this case, in order to accelerate the polymerization reaction, generally used esterification catalysts, such as zinc oxide, stannous oxide, dibutyltin oxide, and dibutyltin dilaurate, may be added. Also, in order to accelerate the reaction, the polyester resin may be produced under a reduced pressure.

Examples of the waxes usable in the present invention include one or more compounds selected from the group consisting of polyolefins, metal salts of fatty acids, fatty acid esters, partially saponified fatty acid esters, higher fatty acids, higher alcohols, paraffin waxes, amide waxes, and polyhydric alcohol esters.

Examples of the above polyolefins include resins such as polypropylenes, polyethylenes, and polybutenes, which have softening points of from 80° to 160° C.

Examples of the above metal salts of fatty acids include metal salts of maleic acid with zinc, magnesium, and calcium; metal salts of stearic acid with zinc, cadmium, barium, lead, iron, nickel, cobalt, copper, aluminum, and magnesium; dibasic lead stearate; metal salts of oleic acid with zinc, magnesium, iron, cobalt, copper, lead, and calcium; metal salts of palmitic acid with aluminum and calcium; caprylates; lead caproate; metal salts of linoleic acid with zinc and cobalt; calcium ricinoleate; metal salts of ricinoleic acid with zinc and cadmium; and mixtures thereof.

Examples of the above fatty acid esters include ethyl maleate, butyl maleate, methyl stearate, butyl stearate, cetyl palmitate, and ethylene glycol montanate.

Examples of the above partially saponified fatty acid esters include montanic acid esters partially saponified with calcium.

Examples of the above higher fatty acids include dodecanoic acid, lauric acid, myristic acid, palmitic acid, stearic acid, oleic acid, linoleic acid, ricinoleic acid, arachic acid, behenic acid, lignoceric acid, selacholeic acid, and mixtures thereof.

Examples of the above higher alcohols include dodecyl alcohol, lauryl alcohol, myristyl alcohol, palmityl alcohol, stearyl alcohol, arachyl alcohol, and behenyl alcohol.

Examples of the above paraffin waxes include natural paraffins, microcrystalline waxes, synthetic paraffins, Fischer Tropsch wax, and chlorinated hydrocarbons.

Examples of the above amide waxes include stearamide, oleamide, palmitamide, lauramide, behenamide, methylenebisstearamide, ethylenebisstearamide, N,N'-m-xylylenebisstearamide, N,N'-m-xylylenebis-12-hydroxystearamide, N,N'-isophthalic bisstearylamide, and N,N'-isophthalic bis-12-hydroxystearylamide.

Examples of the above polyhydric alcohol esters include glycerol stearate, glycerol ricinolate, glycerol monobehenate, sorbitan monostearate, propylene glycol monostearate, and sorbitan trioleate.

Among them, in order to easily disperse the wax with a length to diameter ratio in the range of from 2 to 15 in the toner, a preference is given to polyolefin waxes having weight-average molecular weights of 10,000 or less, preferably weight-average molecular weights of from 7,000 to 10,000, and particularly to polypropylene waxes having weight-average molecular weights of from 7,000 to 10,000.

These waxes are added in amount of 1 to 5 parts by weight, preferably 1 to 3 parts by weight, based on 100 parts by weight of the binder resin. From the viewpoint of giving sufficient offset resistance to the resulting toner, the wax is added in an amount of 1 part by weight or more, and from the viewpoint of improving filming resistance and dispersibilities of other internal additives, the wax is added in an amount of 5 parts by weight or less.

In the toner usable for the present invention, the above wax is well dispersed in the toner with a length to diameter ratio of in the range of from 2 to 15, preferably 5 to 10. When the length to diameter ratio in the toner is less than 2, the dispersibility becomes poor, thereby making it difficult to obtain a high image density at a low development voltage. In particular, under high-temperature, high-humidity conditions, filming is liable to be formed on the photoconductor. On the other hand, when the length to diameter ratio in the toner exceeds 15, the offset resistance becomes unsatisfactory.

The relationship between the dispersibility of the wax and the image density at a low development voltage is such that when the wax is dispersed in a length to diameter ratio in the range of from 2 to 15 in the toner, a high image density can be obtained even at a low development voltage. When the wax is dispersed in a length to diameter ratio of less than 2, so-called "filming" takes place, wherein the toners are melted and adhered on the photoconductor, thereby making evenness of the resulting formed images drastically poor. The filming takes place presumably for the following reasons. Since the dispersion state of the wax in the toner becomes poor, the toners are pulverized at a portion containing wax components, so that the wax appears at the interface of the toner, thereby making it liable to be melted and adhered to the photoconductor, particularly under high-temperature, high-humidity conditions.

Here, the length to diameter ratio is a ratio of length (length along the major axis) to diameter (length along the minor axis) of the dispersed domain measured to cross section of the toner, the ratio being calculated by obtaining the length and the diameter of the toner by the steps of slicing the toner using a microtome to a thickness of 100 to 300 nm, observing the obtained thin slices using a transmission scanning electron microscope (for instance, "JEM-2000," manufactured by JEOL (Nihon Denshi Kabushiki Kaisha)), and then analyzing observed images by a known method. Specifically, length to diameter ratios of in the dispersed domain are measured twenty times in electron photomicrographs, and then an average value thereof is obtained.

In the toner usable for the present invention, the above wax is well dispersed in the toner with a diameter of preferably 0.4 μm or less, more preferably 0.2 μm or less, within which range high image density images can be obtained at a low development voltage, and filming to the photoconductor hardly takes place even under high-temperature, high-humidity conditions.

Also, in the toner usable for the present invention, examples of the colorants which are usable together with the above binder resins include carbon blacks, Phthalocyanine Blue, Rhodamine-B Base, nigrosine dyes, chromium yellow, Lamp Black, Oil Blacks, and mixtures thereof. The colorant is usually used in an amount of about 1 to 15 parts by weight based on 100 parts by weight of the binder resin. In particular, a preference is given to carbon blacks.

The toners in the present invention can be obtained by the steps of uniformly dispersing the binder resin in the present invention, a coloring agent, and in certain cases, property improvers, melt-kneading the obtained mixture, cooling the kneaded mixture, pulverizing the cooled mixture, and then classifying the pulverized product, all of the steps being carried out by known methods. The resulting toners have an average particle size of from preferably 4 to 25 μm, more preferably from 5 to 15 μm.

In the present invention, the above toners may be produced by the following method:

(a) melt-kneading starting materials containing a binder resin, a wax, and a colorant;

(b) cooling and solidifying the melt-kneaded mixture obtained in step (a) from a melt-kneading temperature to a solidification temperature at a cooling rate sufficient to give a length to diameter ratio of from 2 to 15; and (c) finely pulverizing and classifying the solidified product obtained in step (b), to give a toner.

Specifically, by making the cooling rate of the toner in a molten state faster than the ordinary cooling rate, the dispersion state of the wax can be suitably controlled so as to have particle sizes within the above-given ranges. For instance, the desired dispersion state of a toner can be obtained by melt-kneading the starting materials and then cooling from a melt-kneading temperature to a solidification temperature of the melt-kneaded product in a period of 1 to 5 seconds, preferably 1 to 3 seconds. The cooling rate may be controlled as above by varying cooling efficiencies by such means of changing a ventilation temperature or a cooling area of the extruded kneaded product.

In the present invention, a charge control agent may be optionally added to the toner. The positive charge control agents are not particularly limited, and examples thereof include nigrosine dyes such as "NIGROSINE BASE EX" (manufactured by Orient Chemical Co., Ltd.), "OIL BLACK BS" (manufactured by Orient Chemical Co., Ltd.), "OIL BLACK SO" (manufactured by Orient Chemical Co., Ltd.), "BONTRON N-01" (manufactured by Orient Chemical Co., Ltd.), "BONTRON N-07" (manufactured by Orient Chemical Co., Ltd.), and "BONTRON N-11" (manufactured by Orient Chemical Co., Ltd.); triphenylmethane dyes containing tertiary amines as side chains; quaternary ammonium salt compounds such as "BONTRON P-51" (manufactured by Orient Chemical Co., Ltd.), cetyltrimethylammonium bromide, and "COPY CHARGE PX VP435" (manufactured by Hoechst); polyamine resins such as "AFP-B" (manufactured by Orient Chemical Co., Ltd.); and imidazole derivatives such as "PLZ-2001" (manufactured by Shikoku Kasei K.K.) and "PLZ-8001" (manufactured by Shikoku Kasei K.K.), with a preference given to BONTRON N-07 and BONTRON P-51.

Negative charge control agents to be added are not particularly limited, and examples thereof include azo dyes containing metals such as "VARIFAST BLACK 3804" (manufactured by Orient Chemical Co., Ltd.), "BONTRON S-31" (manufactured by Orient Chemical Co., Ltd.), "T-77" (manufactured by Hodogaya Chemical Co., Ltd.), "BON- TRON S-32" (manufactured by Orient Chemical Co., Ltd.), "BONTRON S-34" (manufactured by Orient Chemical Co., Ltd.), and "AIZEN SPILON BLACK TRH" (manufactured by Hodogaya Chemical Co., Ltd.); copper phthalocyanine dyes; metal complexes of alkyl derivatives of salicylic acid such as "BONTRON E-81" (manufactured by Orient Chemical Co., Ltd.), "BONTRON E-82" (manufactured by Orient Chemical Co., Ltd.), "BONTRON E-84" (manufactured by Orient Chemical Co., Ltd.), and "BONTRON E-85" (manufactured by Orient Chemical Co., Ltd.); quaternary ammonium salts such as "COPY CHARGE NX VP434" (manufactured by Hoechst); and nitroimidazole derivatives, with a preference given to BONTRON S-34, T-77 and AIZEN SPILON BLACK TRH.

The above charge control agents may be contained in the binder resin in an amount of 0.1 to 5.0% by weight, preferably 0.2 to 3.0% by weight.

The carriers usable in the present invention are not particularly limited, and examples thereof include carriers whose surfaces are coated with various modified silicone oils, such as urethane-modified silicone oils, epoxy-modified silicone oils, acrylate-modified silicone oils, and polyester-modified silicone oils; or those coated with general silicone resins, such as methyl dimethyl silicone and methyl phenyl silicone, with a preference given to those whose surfaces are coated with crosslinked polymers of the silicone resins mentioned above. In the present invention, a preference is given to the carriers whose surfaces are coated with silicone resins comprising a urethane-modified silicone resin as an essential component, and in particular, a greater preference is given to those coated with the silicone resins which are blends of the urethane-modified silicone resins and the crosslinked silicone resins, or those coated with crosslinked products of the urethane-modified silicone resins and other silicone resins. In the present invention, by the use of the above carriers and improvement of dispersibility of the waxes in the toner, fixed images with high image densities can be obtained even at a low development voltage.

As for the base materials of the coated carriers, any magnetic material which is generally known to be usable for carriers may be employed. Examples thereof include ferrite carriers, iron carriers, magnetite carriers, with a preference given to the ferrite carriers and the magnetite carriers because they are widely used.

In the silicone resins for coating the carriers usable in the present invention, it is important to include a urethane-modified silicone resin as an essential component. Here, the urethane-modified silicone resins may be blended with other silicone resins, or they may be crosslinked with other silicone resins. The kinds of the urethane-modified silicone resins are not particularly limited. Although generally commercially available urethane-modified silicone resins are usable for the urethane-modified silicone resins, they may, for instance, be prepared by the following method. Specifically, the method for producing a urethane-modified silicone resin comprises the step of carrying out reaction using an organic resin having a hydroxyl group, a relatively low-molecular weight silicone resin having such a functional group as a methoxy group or a hydroxyl group at the molecular terminus, and a polyisocyanate, to thereby form a urethane bond.

The proportion of the urethane-modified silicone resins in the silicone resin in the present invention is preferably 5% by weight or more and 80% by weight or less. When the proportion of the urethane-modified silicone resins is less than 5% by weight, the mechanical strength and the hardening properties of the developer composition become weak, thereby giving little improvements under high-temperature, high-humidity conditions. On the other hand, when the proportion exceeds 80% by weight, the heat resistance and the weathering resistance of the developer composition become weak, thereby undesirably causing much increase in the background level in the non-image forming portion.

Examples of other silicone resin components usable in the present invention other than the urethane-modified silicone resins include various modified silicone oils, such as epoxy-modified silicone oils, acrylate-modified silicone oils, and polyester-modified silicone oils; and general silicone resins, such as methyl dimethyl silicone and methyl phenyl silicone.

Among the silicone resin components, a preference is given to crosslinked silicone resins. The term "crosslinked silicone resins" refers to silicone resins obtainable by treating a silicone resin with a crosslinking agent. For instance, a crosslinked silicone resin can be obtained by using methyl trimethoxy silane as a crosslinking agent and heat-treating at a temperature of 250° C. or higher. Here, a crosslinked product of the urethane-modified silicone resin and the crosslinked silicone resin can be obtained by using the urethane-modified silicone resin and a polyisocyanate upon crosslinking.

The silicone resins mentioned above may be coated on carriers by one of the following methods. One method comprises previously mixing a urethane-modified silicone resin with other silicone resin components, and then adding a carrier to the resulting mixture. Alternatively, another method comprises mixing various silicone resin components simultaneously with the carrier. Among them, a preference is given to the method for coating carriers where the silicone resin components alone are previously mixed, and then the carrier is added thereto.

The coating methods may be a wet method or a dry method. The wet method comprises the steps of dispersing a silicone resin in a volatile solvent, such as methanol and ethanol, mixing the silicone dispersion with the carrier, and then removing the solvent. The dry method comprises the step of mixing a silicone resin powder with the carrier in a dry state.

The amount of the silicone resin coated on the carrier is from 0.2 to 1.6 parts by weight, based on 100 parts by weight of the carrier. When the amount of the silicone resin is less than 0.2 parts by weight, improvements in giving flat image density under high-temperature, high-humidity conditions is little, and when the amount exceeds 1.6 parts by weight, the function of the carriers is inhibited.

The developer composition for electrostatic latent images can be obtained by blending from 2 to 10 parts by weight of a toner with 100 parts by weight of the carriers using such mixers as a V-type blender.

In the present invention, by using a developer composition comprising a toner containing the above polyester resin and the above carrier, the resulting fixed images can have high image density even at a low development voltage. For instance, in the case of an electrophotographic copy machine used in Test Examples, the development voltage is from about 200 V to about 300 V.

According to the developer composition of the present invention, since the resulting formed images can have high image densities even at a low development voltage, the developer composition can be suitably used in an image-forming process utilizing optical digitized method, and the developer composition show good performance even under severe environmental conditions, and thus giving high-quality formed images. In other words, the present invention can provide a developer suitably used in recent developments of digitization, while retaining the excellent properties of the polyester resins, such as environmental stability, fixing ability, and transparency. Also, the filming is hardly formed on the photoconductor under high-temperature, high-humidity conditions, thereby making it possible to form uniform fixed images.

EXAMPLES

The present invention will be explained in detail by means of the following Production Examples, Examples, Comparative Examples, and Test Examples, without intending to limit the scope of the present invention thereto.

Production Example of Carrier 1

0.3 parts by weight of a silicone resin prepared by previously mixing 5% by weight of ketoxime as a crosslinking agent and a methyl dimethyl silicone resin "SR2400" (manufactured by Dow Corning Toray Silicone Company, LTD.), and 0.2 parts by weight of a urethane-modified silicone resin "KR305" (manufactured by Shin-Etsu Silicone Kabushiki Kaisha), and 0.1 parts by weight of a polyisocyanate "CORONATE 2031" (manufactured by Nippon Polyurethane Industry Co., Ltd.) were dispersed in methyl ethyl ketone, to give a resin coating liquid mixture. The above resin coating liquid mixture was spray-coated on surfaces of 100 parts by weight of spherical ferrites used as core materials by using a fluidizing coating apparatus. Further, the coated core material was heat-treated at 300° C. for 30 minutes in a fluidizing vessel, to give Carrier 1 (hereinafter simply referred to as "C-1") having a resin coating of a crosslinked product of the urethane-modified silicone resin and other silicone resins.

Production Example of Carrier 2

The same procedures as in Production Example of Carrier 1 were carried out except for preparing a resin coating liquid mixture containing 0.9 parts by weight of a silicone resin, which was a methyl dimethyl silicone resin "SR2400" (manufactured by Dow Corning Toray Silicone Company, LTD.) previously mixed with 5% by weight of methyl trimethoxy silane as a crosslinking agent, to give Carrier 2 (hereinafter simply referred to as "C-2").

Production Example of Toner 1

In a four-neck flask equipped with a stirrer, a reflux condenser, a thermometer, and a nitrogen inlet tube, 175 g of polyoxypropylene(additional molar number: 2.0) bisphenol A, 162.5 g of polyoxyethylene(additional molar number: 2.0) bisphenol A, 83 g of terephthalic acid, 38.4 g of trimellitic acid anhydride, and 53.6 g of dodecenylsuccinic acid were placed together with stannous oxide used as a catalyst. The contents were heated to 220° C., and condensation polymerization was carried out while stirring the contents under a nitrogen atmosphere, to give a pale yellow resin (acid value 2 KOH mg/g).

To 100 parts by weight of this resin, 8 parts by weight of a carbon black "MOGUL-L" (manufactured by Cabot Corporation), 1.5 parts by weight of a charge control agent "BONTRON S-34" (manufactured by Orient Chemical Co., Ltd.), and 3.0 parts by weight of a polypropylene wax "VISCOL 660P" (manufactured by Sanyo Chemical Industries, Ltd.) having a weight-average molecular weight of 9,500 were added and melt-kneaded and extruded by using a twin-screw extruder "PCM-20" (manufactured by Ikegai Corporation). The extruded product was rapidly cooled while blowing cold air. In this case, the cooling time from the kneading temperature to the solidification temperature of the kneaded product was two seconds.

The resulting solidified product was finely pulverized and then classified, to give a toner having an average particle size of 8 μm. Further, 100 parts by weight of the toner was stir-blended with 0.5 parts by weight of a hydrophobic silica "AEROSIL R-972" (manufactured by Nippon Aerozil Ltd.), to give Toner 1 (hereinafter simply referred to as "T-1"). The wax had a length to diameter ratio (L/D ratio) of 8, and the diameter of 0.15 μm, each of the measurements being conducted by the methods explained above. Incidentally, FIG. 1 is an electron photomicrograph showing the object of measurement, wherein the dispersed entities are near-transparent and dispersed in a toner in the form of oval shapes or acicular shapes, which mainly consist of a wax.

Production Example of Toner 2

The same procedures as in Production Example of Toner 1 were carried out except for changing the polypropylene wax "VISCOL 660P" to a polypropylene wax "NP-055" (manufactured by Mitsui Petrochemical Industries, Ltd.) having a weight-average molecular weight of 8,300, to give Toner 2 (hereinafter simply referred to as "T-2"). The wax had a length to diameter ratio (L/D ratio) of 7, and the diameter of 0.12 μm, each of the measurements being conducted by the methods explained above.

Production Example of Toner 3

The same procedures as in Production Example of Toner 1 were carried out except for changing the polypropylene wax "VISCOL 660P" to a polypropylene wax "VISCOL 550P" (manufactured by Sanyo Chemical Industries, Ltd.) having a weight-average molecular weight of 15,000, to give Toner 3 (hereinafter simply referred to as "T-3"). The wax had a length to diameter ratio (L/D ratio) of 1.8, and the diameter of 0.55 μm, each of the measurements being conducted by the methods explained above.

Production Example of Toner 4

The same procedures as in Production Example of Toner 1 were carried out except for changing the ventilation temperature so as to have a cooling time of ten seconds, to give Toner 4 (hereinafter simply referred to as "T-4"). The wax had a length to diameter ratio (L/D ratio) of 1.2, and the diameter of 0.62 μm, each of the measurements being conducted by the methods explained above.

Production Example of Toner 5

The same procedures as in Production Example of Toner 1 were carried out except for changing the polypropylene wax "VISCOL 660P" to a polyethylene wax "HIWAX 720P" (manufactured by Mitsui Petrochemical Industries, Ltd.) having a weight-average molecular weight of 7,300, to give Toner 5 (hereinafter simply referred to as "T-5"). The wax had a length to diameter ratio (L/D ratio) of 5, and the diameter of 0.20 μm, each of the measurements being conducted by the methods explained above.

Examples 1 to 4 and Comparative Examples 1 to 3

To 1,000 parts by weight of the carriers prepared in each of Carrier Production Examples, 40 parts by weight of each of Toners prepared in Production Examples of Toners were added, and the resulting mixture was blended by using a 10-liter V-type blender, to give each of the developers with various combinations of Toners and Carriers as shown in Table 1.

Test Example 1 (Image Density)

Using each of the developers obtained in Examples and Comparative Examples, an image density test was conducted using a commercially available electrophotographic copy machine by the method given below.

Specifically, by having voltage bias of the copy machine variable and decreasing the bias voltage in 50 V intervals from a high voltage of about −550 V to a low voltage of about −200 V, three copies each were taken at each voltage, and image densities of each of the resulting copy samples were measured by an image densitometer "RD914" (manufactured by Macbeth Process Measurements Co.). Also, a surface voltage $V_L$ of the photoconductor upon copying was measured, and a development voltage was calculated by the following equation:

| Development Voltage | = | Surface Voltage ($V_L$) | − | Development Bias Voltage |
|---|---|---|---|---|

The development voltage at which the image density becomes 1.4 or higher was determined for each of the developers. From the above results, the image density at low development voltages was evaluated according to the following standards.

⊙: Development voltage of from 200 to 250 V;

○: Development voltage of from 250 to 300 V;

Δ: Development voltage of from 300 to 350 V; and x: Development voltage of 350 V or more.

The results are shown in Table 1.

TABLE 1

| | Example Nos. | | | | Comparative Example Nos. | | |
|---|---|---|---|---|---|---|---|
| | 1 | 2 | 3 | 4 | 1 | 2 | 3 |
| Toner Nos. | T-1 | T-2 | T-5 | T-1 | T-3 | T-4 | T-4 |
| L/D Ratio | 8 | 7 | 5 | 8 | 1.8 | 1.2 | 1.2 |
| Diameter μm | 0.15 | 0.12 | 0.20 | 0.15 | 0.55 | 0.62 | 0.62 |
| Carrier Nos. | C-1 | C-1 | C-1 | C-2 | C-1 | C-1 | C-2 |
| Coating Agents | Urethane-Modified Silicone & Methyl Dimethyl Silicone | Urethane-Modified Silicone & Methyl Dimethyl Silicone | Urethane-Modified Silicone & Methyl Dimethyl Silicone | Methyl Dimethyl Silicone | Urethane-Modified Silicone & Methyl Dimethyl Silicone | Urethane-Modified Silicone & Methyl Dimethyl Silicone | Methyl Dimethyl Silicone |
| Image Density | ○ | ⊙ | ○ | ○ | Δ | X | X |
| Development Voltage | 260 V | 235 V | 290 V | 280 V | 330 V | 385 V | 400 V |

As is clear from Table 1, with the developers of Examples 1 to 4, high image densities were obtained even at low development voltages. On the other hand, with the developers of Comparative Examples 1 to 3 where the dispersibilities of the waxes were poor, high image densities were not obtained at low development voltages.

Test Example 2 (Environmental Resistance)

Using each of the developers obtained in Examples and Comparative Examples and the same electrophotographic copy machine as in Test Example 1 (developer bias voltage: −400 V), a test was conducted under low-temperature, low-humidity conditions of 10° C. and 20% RH and under high-temperature, high-humidity conditions of 35° C. and 85% RH. From the above results, the environmental resistance was evaluated according to the following standards:

○: Fixed images with an image density of 1.4 or more, and background level of 0.01 or less;

Δ: Fixed images with either one of the image density or a background level not satisfying the above level in ○; and x: Fixed images with both the image density and the background level not satisfying the above level in ○.

The results are shown in Table 2.

TABLE 2

| | | | Environmental Conditions | | | | | |
|---|---|---|---|---|---|---|---|---|
| | | | Normal Temp., Normal Humidity (25° C./50%) | | High Temp., High Humidity (35° C./85%) | | Low Temp., Low Humidity (10° C./20%) | |
| | Toner No. | Carrier No. | at Start | After 20,000 Sheets | at Start | After 20,000 Sheets | at Start | After 20,000 Sheets |
| Example Nos. | | | | | | | | |
| 1 | T-1 | C-1 | ○ | ○ | ○ | ○ | ○ | ○ |
| | Image Density | | 1.45 | 1.45 | 1.44 | 1.42 | 1.43 | 1.43 |
| | Background Level | | <0.01 | <0.01 | <0.01 | <0.01 | <0.01 | <0.01 |
| 2 | T-2 | C-1 | ○ | ○ | ○ | ○ | ○ | ○ |
| | Image Density | | 1.46 | 1.45 | 1.45 | 1.44 | 1.44 | 1.44 |
| | Background Level | | <0.01 | <0.01 | <0.01 | <0.01 | <0.01 | <0.01 |
| 3 | T-5 | C-1 | ○ | ○ | ○ | ○ | ○ | ○ |
| | Image Density | | 1.44 | 1.43 | 1.43 | 1.42 | 1.43 | 1.41 |
| | Background Level | | <0.01 | <0.01 | <0.01 | <0.01 | <0.01 | <0.01 |
| 4 | T-1 | C-2 | ○ | ○ | ○ | ○ | ○ | ○ |
| | Image Density | | 1.45 | 1.42 | 1.46 | 1.40 | 1.44 | 1.40 |
| | Background Level | | <0.01 | <0.01 | <0.01 | <0.01 | <0.01 | <0.01 |
| Comparative Example Nos. | | | | | | | | |
| 1 | T-3 | C-1 | ○ | Δ | X | X | Δ | X |
| | Image Density | | 1.44 | 1.31 | 1.29 | 1.23 | 1.33 | 1.24 |
| | Background Level | | <0.01 | <0.01 | 0.02 | 0.02 | <0.01 | 0.02 |
| 2 | T-4 | C-1 | Δ | X | X | X | X | X |
| | Image Density | | 1.33 | 1.21 | 1.32 | 1.19 | 1.31 | 1.20 |
| | Background Level | | <0.01 | 0.03 | 0.02 | 0.02 | 0.02 | 0.02 |
| 3 | T-4 | C-2 | X | X | X | X | X | X |
| | Image Density | | 1.31 | 1.17 | 1.34 | 1.02 | 1.34 | 1.11 |
| | Background Level | | 0.01 | 0.02 | 0.02 | 0.05 | 0.01 | 0.02 |

As is clear from Table 2, in cases of Toners of the present invention, high quality images can be obtained even under high-temperature, high-humidity conditions or low-temperature, low-humidity conditions in a level substantially not different from those obtained under normal temperature, normal humidity (25° C., 50% RH). Also, even under high-temperature, high-humidity conditions or low-temperature, low-humidity conditions, the resulting fixed images retained good image quality, with substantially no changes in the image densities and the background levels even after 20,000 continuous copies. Incidentally, the image densities and the background levels were measured by using an image densitometer "RD914" (manufactured by Macbeth Process Measurements Co.).

Test Example 3 (Filming on Photoconductor)

A similar test as in Test Example 2 was conducted under high-temperature, high-humidity conditions of 35° C. and 85% RH, and a continuous copy test was conducted with paper sheets containing black/white image portion of about 5 to 10%, and at every 1000 sheet interval of continuous copying, a paper sheet with an entire surface of solid image portion was copied and checked on the whitening of the formed images and also checked on the adhesion of the toner on the photoconductor. The operation was repeated until conducting 5000 sheets of continuous copying. From the above results, the filming properties were evaluated according to the following standards:

○: No filming took place even at copying 5,000 sheets.

Δ: Filming took place after copying 2,000 to 5,000 sheets.

x: Filming took place after copying sheets not exceeding 2,000 sheets.

The results are shown in Table 3.

TABLE 3

| | Examples | | | | Comparative Examples | | |
|---|---|---|---|---|---|---|---|
| | 1 | 2 | 3 | 4 | 1 | 2 | 3 |
| Toner Nos. | T-1 | T-2 | T-5 | T-1 | T-3 | T-4 | T-4 |
| Carrier Nos. | C-1 | C-1 | C-1 | C-2 | C-1 | C-1 | C-2 |
| Filming Resistance | ○ | ○ | ○ | ○ | Δ | × | × |

As is clear from Table 3, in cases of Toners of Examples, no filming took place even when copying 5,000 sheets or more. On the other hand, in cases of Toners of Comparative Examples 1 to 3 where the dispersibilities of the waxes were poor, filming took place before the number of copies reached 5,000 sheets, or before reaching 2,000 sheets in certain cases.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A developer composition for electrostatic latent images comprising a toner and a carrier, the toner comprising:

(a) a binder resin comprising a polyester resin having an acid value of from 0 to 10 KOH mg/g;

(b) a wax; and (c) a colorant, wherein said wax is dispersed in the toner with a length to diameter ratio of from 2 to 15, and wherein said wax is one or more compounds selected from the group consisting of polyolefins having a weight-average molecular weight of 10,000 or less, metal salts of fatty acids, fatty acid esters, partially saponified fatty acid esters, higher fatty acids, higher alcohols, paraffin waxes, amide waxes, and polyhydric alcohol esters.

2. The developer composition according to claim 1, wherein said polyolefin wax is a polypropylene wax having a weight-average molecular weight of from 7,000 to 10,000.

3. The developer composition according to claim 1, wherein said wax is dispersed in the toner with a minor axis of 0.4 $\mu$m or less.

4. The developer composition according to claim 1, wherein said wax is added in an amount of 1 to 5 parts by weight, based on 100 parts by weight of the binder resin.

5. The developer composition according to claim 1, wherein said polyester resin is obtainable by condensation polymerization between a polycarboxylic acid and a diol as main components thereof, wherein said polycarboxylic acid has the following general formula (I) and said diol has the following general formula (II):

$$R_2O-\underset{\underset{O}{\|}}{C}-R_1-(\underset{\underset{O}{\|}}{C}-OR_2)_p \quad (I)$$

$$HO-R_3-OH \quad (II)$$

wherein "p" is equal to or greater than 1; $R_1$ stands for a benzene ring; $R_2$ stands for a hydrogen atom or a lower alkyl group; $R_3$ stands for a divalent group containing a bisphenol group or an alkylene group having 2 to 6 carbon atoms, wherein polycarboxylic acid components having "p" of equal to or greater than 2 are contained in an amount of 0.06 to 0.60 molt in the acid components.

6. The developer composition according to claim 1, wherein said toner is produced by the method comprising the steps of:

(a) melt-kneading starting materials containing a binder resin, a wax, and a colorant;

(b) cooling and solidifying the melt-kneaded mixture obtained in step (a) from a melt-kneading temperature to a solidification temperature at a cooling rate sufficient to give a length to diameter ratio of from 2 to 15; and (c) finely pulverizing and classifying the solidified product obtained in step (b), to give a toner.

7. The developer composition according to claim 1, wherein said carrier is coated on a surface thereof by a silicone resin comprising a urethane-modified silicone resin as an essential component.

8. The developer composition according to claim 7, wherein said silicone resin is a blend of a urethane-modified silicone and a crosslinked silicone, or a crosslinked product of the urethane-modified silicone resin and other silicone resins.

9. The developer composition according to claim 6, wherein a cooling time is 1 to 5 seconds.

10. A process for producing a developer composition for electrostatic latent images comprising a toner and a carrier, the toner comprising a binder resin comprising a polyester resin having an acid value of from 0 to 10 KOH mg/g; a wax; and a colorant, wherein said wax is dispersed in the toner with a length to diameter ratio of from 2 to 15, the process comprising the steps of:

(a) melt-kneading starting materials containing a binder resin, a wax, and a colorant;

(b) cooling and solidifying the melt-kneaded mixture obtained in step (a) from a melt-kneading temperature to a solidification temperature at a cooling rate sufficient to give a length to diameter ratio of from 2 to 15, and wherein said wax is one or more compounds selected from the group consisting of polyolefins having a weight- average molecular weight of 10,000 or less, metal salts of fatty acids, fatty acid esters, partially saponified fatty acid esters, higher fatty acids, higher alcohols, paraffin waxes, amide waxes, and polyhydric alcohol esters; and (c) finely pulverizing and classifying the solidified product obtained in step (b), to give a toner.

11. The process according to claim 1, wherein said polyolefin wax is a polypropylene wax having a weight-average molecular weight of from 7,000 to 10,000.

12. The process according to claim 10, wherein said wax is dispersed in the toner with a minor axis of 0.4 $\mu$m or less.

13. The process according to claim 10, wherein said wax is added in an amount of 1 to 5 parts by weight, based on 100 parts by weight of the binder resin.

14. The process according to claim 10, wherein said polyester resin is obtainable by condensation polymerization between a polycarboxylic acid and a diol as main components thereof, wherein said polycarboxylic acid has the following general formula (I) and said diol has the following general formula (II):

$$R_2O-\underset{\underset{O}{\|}}{C}-R_1-(\underset{\underset{O}{\|}}{C}-OR_2)_p \quad (I)$$

$$HO-R_3-OH \quad (II)$$

wherein "p" is equal to or greater than 1; $R_1$ stands for a benzene ring; $R_2$ stands for a hydrogen atom or a lower alkyl group; $R_3$ stands for a divalent group containing a bisphenol group or an alkylene group having 2 to 6 carbon atoms, wherein polycarboxylic acid components having "p" of equal to or greater than 2 are contained in an amount of 0.06 to 0.60 mol % in the acid components.

15. The process according to claim 10, wherein the cooling rate is 1 to 5 seconds.

* * * * *